US010687621B2

(12) United States Patent
Harder et al.

(10) Patent No.: US 10,687,621 B2
(45) Date of Patent: Jun. 23, 2020

(54) SPACER ASSEMBLY

(71) Applicant: NewAge Products, Inc., Vaughan (CA)

(72) Inventors: Mitch Harder, Toronto (CA); Robert Vandenham, North York (CA)

(73) Assignee: NewAge Products Inc., Vaughan (CA)

( * ) Notice: Subject to any disclaimer, the term of this patent is extended or adjusted under 35 U.S.C. 154(b) by 0 days.

(21) Appl. No.: 15/953,035

(22) Filed: Apr. 13, 2018

(65) Prior Publication Data

US 2018/0295987 A1 Oct. 18, 2018

Related U.S. Application Data

(60) Provisional application No. 62/485,639, filed on Apr. 14, 2017.

(51) Int. Cl.
*A47B 87/00* (2006.01)
*A47B 95/04* (2006.01)

(52) U.S. Cl.
CPC ..... *A47B 87/008* (2013.01); *A47B 95/04* (2013.01)

(58) Field of Classification Search
CPC ..... A47B 87/007; A47B 87/008; A47B 87/00; A47B 95/00; A47B 95/04; A47B 2230/00; A47B 2230/07
See application file for complete search history.

(56) References Cited

U.S. PATENT DOCUMENTS 1,836,901 A * 12/1931 Russell ..... A47B 47/03 211/134
2,599,322 A 6/1952 Drain
3,178,244 A 4/1965 Reiss et al.
3,351,400 A * 11/1967 Sholtes ..... A47B 47/03 312/107
3,352,615 A 11/1967 Sandin
4,461,519 A * 7/1984 Hildebrandt ..... A47B 47/03 312/223.6
4,844,565 A 7/1989 Brafford et al.
5,350,227 A * 9/1994 Katz ..... A47B 87/00 312/111
5,951,127 A 9/1999 Smith
6,678,161 B1 * 1/2004 Claprood ..... G06F 1/182 361/724
6,899,404 B1 5/2005 King
6,938,966 B1 9/2005 Rouwhorst
(Continued)

FOREIGN PATENT DOCUMENTS

GB 183679 A * 8/1922 ..... A47B 87/008

*Primary Examiner* — Andrew M Roersma
(74) *Attorney, Agent, or Firm* — Howard & Howard Attorneys PLLC

(57) ABSTRACT

A spacer assembly for use in supporting and securing a first cabinet subassembly to a second cabinet subassembly to form a cabinet assembly includes a first frame member, a second frame member and a decorative cover. The first frame member extends between a top attachment end and a top non-attachment end and includes a mount having an indented ledge coupled at the top attachment end. The second frame member extends between a bottom attachment end and a bottom non-attachment end and includes a bottom plate extending from the bottom attachment end and a flange extending outwardly away from the bottom plate. The decorative cover is coupled onto the mount of the first frame member and onto the flange of the second frame member.

17 Claims, 16 Drawing Sheets

(56) References Cited

U.S. PATENT DOCUMENTS

| | | | | |
|---|---|---|---|---|
| 6,945,616 | B2 * | 9/2005 | Webster | H02B 1/50 312/223.1 |
| 7,950,199 | B2 | 5/2011 | Newhouse et al. | |
| 7,958,691 | B1 | 6/2011 | Newhouse et al. | |
| 8,511,293 | B2 | 8/2013 | Thompson et al. | |
| 8,668,283 | B2 * | 3/2014 | Fan | H05K 7/1489 312/111 |
| 2008/0067900 | A1 * | 3/2008 | Marshall | A47B 87/008 312/108 |

* cited by examiner

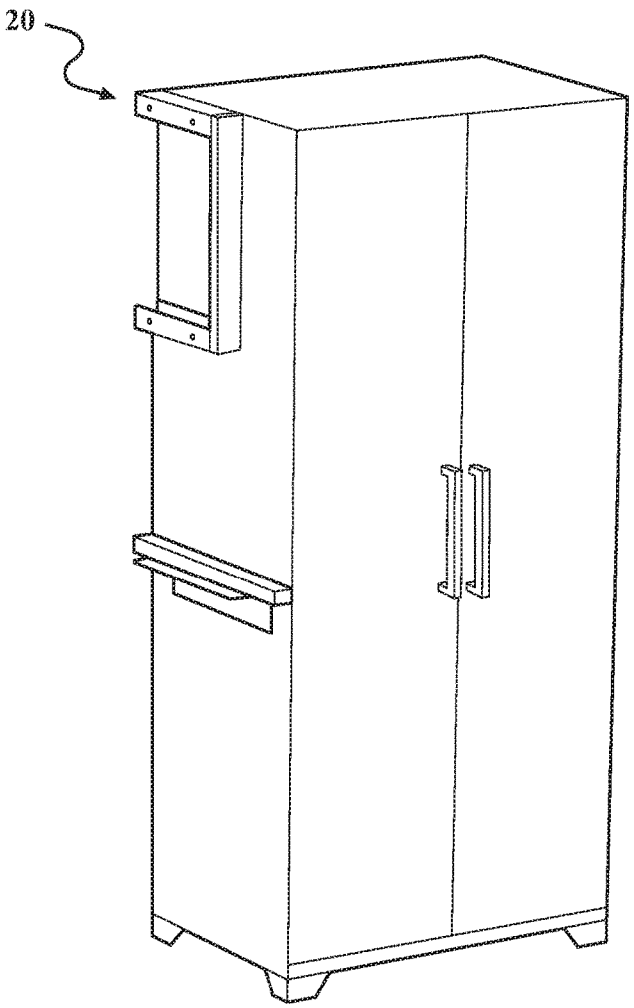
FIG. 3
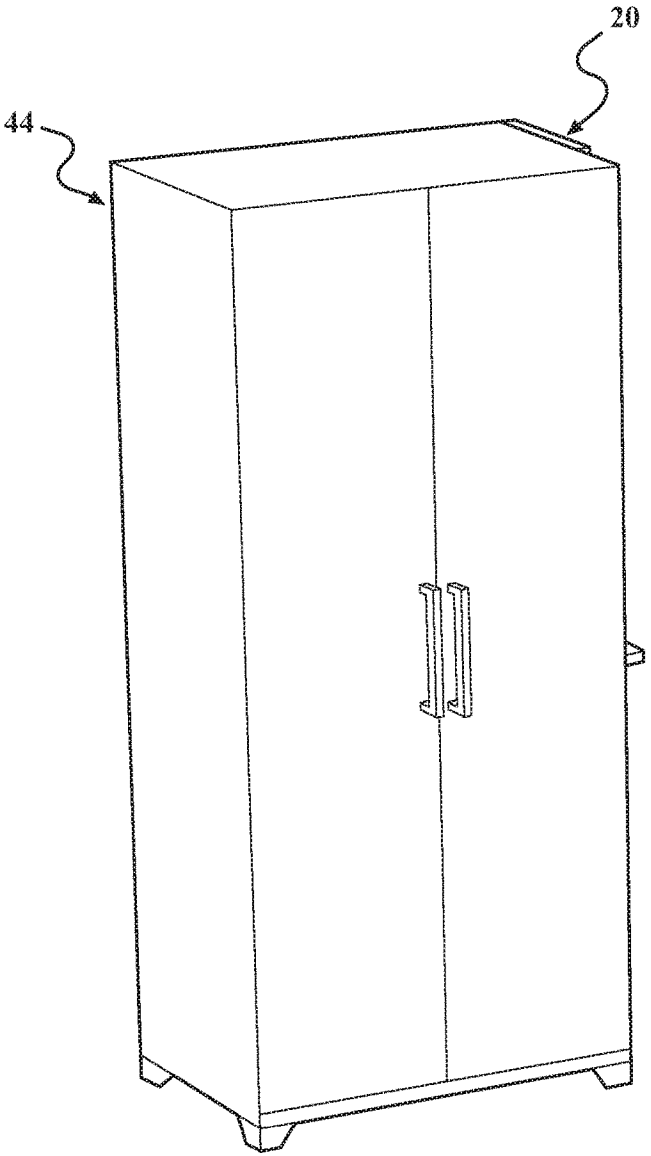

SPACER ASSEMBLY

CROSS-REFERENCE TO RELATED APPLICATIONS

The present invention claims priority to U.S. Provisional Application No. 62/485,639, filed Apr. 14, 2017, the contents of which are hereby incorporated by reference.

FIELD OF THE DISCLOSURE

The present invention relates, generally, to a spacer assembly for supporting and securing a first cabinet assembly to a second cabinet assembly and for providing an aesthetically pleasing decorative cover therebetween.

DESCRIPTION OF RELATED ART

It is also well known to attach individual storage cabinets (i.e., cabinet subassemblies) together along their side walls where cabinet assemblies having additional storage capabilities is desired. Typically, the cabinet subassemblies are coupled together by bringing their sidewalls into an abutting relationship and inserting fastening devices, such as screws or bolts, through the side walls. The resultant cabinet assembly thus include a seam corresponding to the juncture of the cabinet subassemblies that is aesthetically unpleasing. To remedy this, it has been proposed to include moldings, facing strips or the like at the juncture. These moldings or facing strips are typically permanently installed and are not readily removable or replaceable.

However, there are instances wherein the two cabinet subassemblies are desired to be coupled together in a spaced relationship to one another to form a cabinet assembly. For example, it may be desirable to attach a flat workdesk, or support tray, between the two cabinet subassemblies and then attach one or more upper suspended cabinet subassemblies that extend above the workdesk for storage. It is also desirable wherein the cabinet subassemblies have be easily disassembled, and reassembled in a different configuration, as desired. The present invention is directed to a spacer assembly that addresses some of these desirable attributes.

SUMMARY OF THE INVENTION

One embodiment of the spacer assembly for use in supporting and securing a first cabinet subassembly to a second cabinet subassembly to form a cabinet assembly includes a first frame member, a second frame member and a decorative cover. The first frame member extends between a top attachment end and a top non-attachment end and includes a mount having an indented ledge coupled at the top attachment end. The second frame member extends between a bottom attachment end and a bottom non-attachment end and includes a bottom plate extending from the bottom attachment end and a flange extending outwardly away from the bottom plate. The decorative cover is coupled onto the mount of the first frame member and onto the flange of the second frame member. A male fastening member secures the decorative cover to the second frame member.

In a further embodiment, a cabinet assembly includes the spacer assembly as described above that is positioned between each of a first cabinet subassembly to a second cabinet subassembly. In this further embodiment, the first and second frame members include protrusions defining bores that are respectively axially aligned with corresponding bores in the first and second cabinet subassemblies, and wherein male fastening members are inserted through the axially aligned bores to secure the spacer assembly to each of the respective first and second cabinet subassembly.

In a still further embodiment, an associated method for forming the cabinet assembly by securing the aforementioned spacer assembly between the aforementioned first and second cabinet subassembly is also provided.

The spacer assembly of the present invention provides sufficient structural support and a desirable aesthetic appearance for forming cabinet assemblies from cabinet subassemblies. The spacer assembly is easy to install, and easy to disassemble after installation, thus allowing cabinet subassemblies to be arranged, and rearranged, in a wide variety of different ways as desired.

BRIEF DESCRIPTION OF THE DRAWINGS

Advantages of the present invention will be readily appreciated as the same becomes better understood by reference to the following detailed description when considered in connection with the accompanying drawings.

FIG. 3 is a perspective view of two of the spacer assemblies, each coupled to the first cabinet assembly.

DETAILED DESCRIPTION OF THE DISCLOSURE

Referring now to the figures, wherein like numerals indicate like or corresponding parts, a spacer assembly 20 is generally shown in FIGS. 1-4 and 7-18. Generally, the spacer assembly 20 includes a first frame member 22 extending along a longitudinal axis A and a second frame member 24 extending parallel to the longitudinal axis A. The spacer assembly 20 additionally includes a decorative cover 26, extending normal to the longitudinal axis A mounted to the first frame member 22, and fastened to the second frame member 24.

The longitudinal axis A, as described herein, is not intended to describe an axis that is generally parallel to or along the lines of longitude associated with describing map coordinates of the earth that extend between the north and south pole, but is intended to generally describe the longest lengthwise direction of the part described (here the first frame member 22. Accordingly, further descriptions of the longitudinal axis A of other components are described in terms of the relative orientation to the first frame member 22 as described herein.

Figure 1:
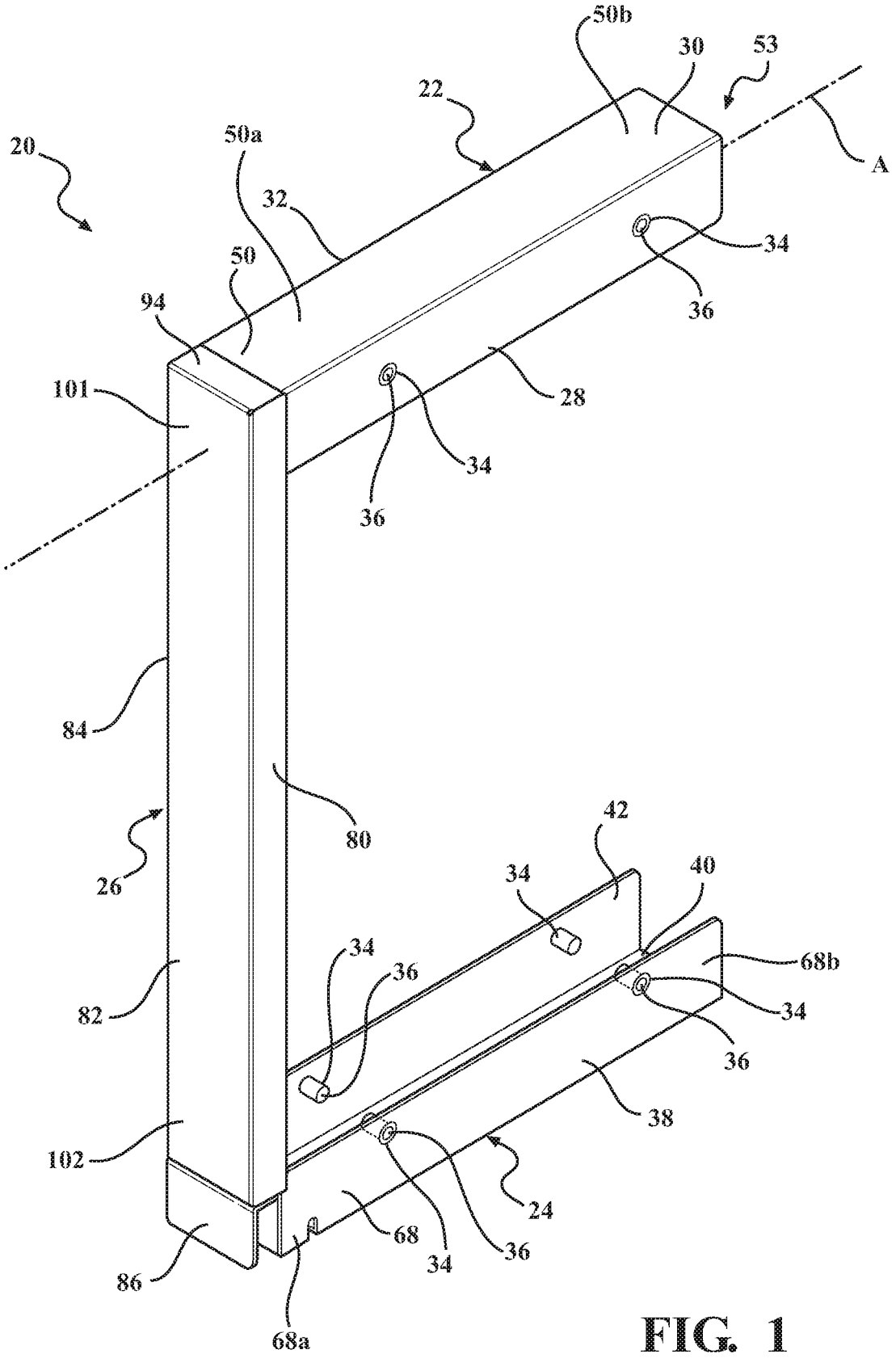
FIG. 1 is a perspective view of a spacer assembly of the present invention.
Figure 2:
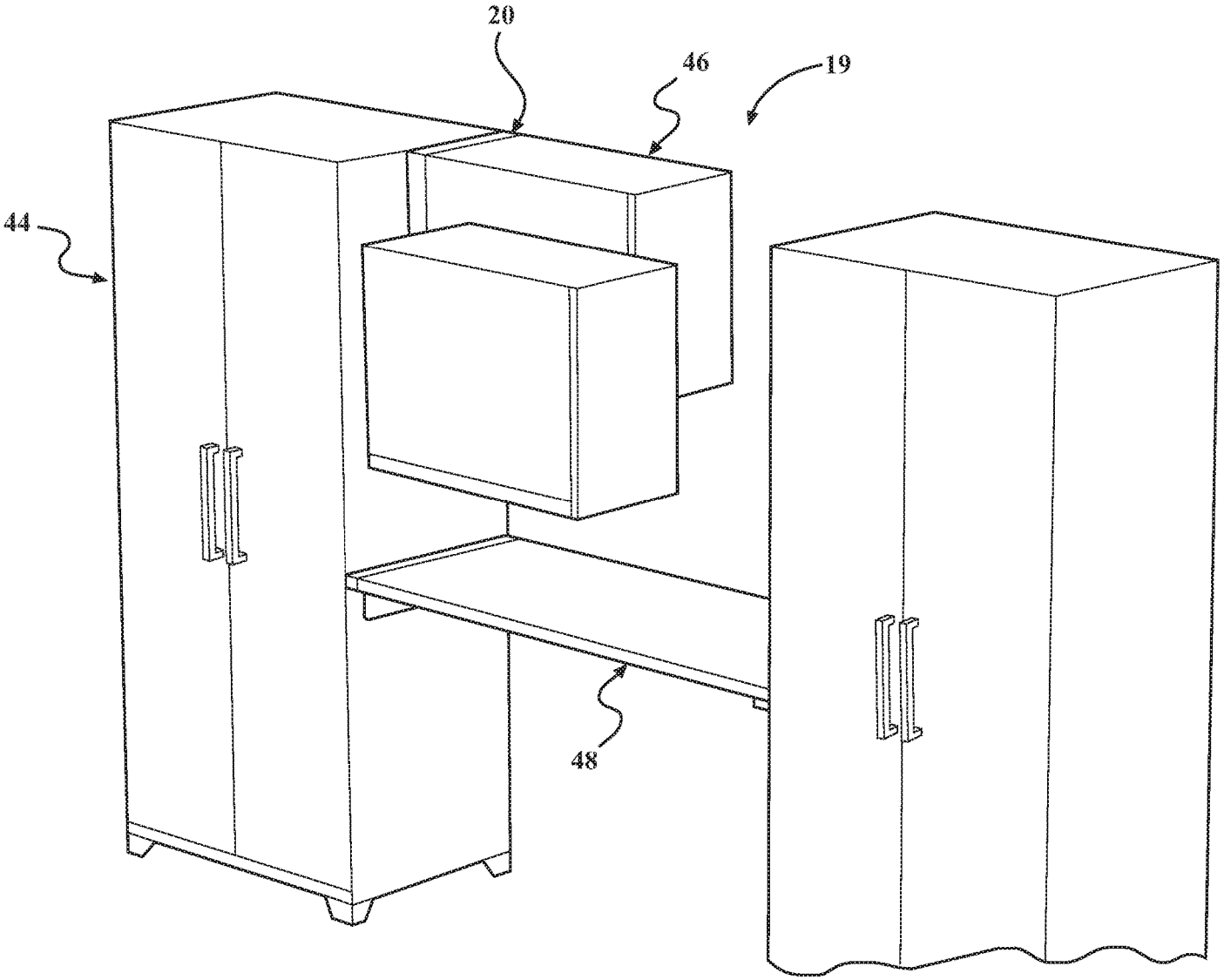
FIG. 2 is a perspective view of a cabinet including the spacer assembly of FIG. 1 coupled to a first cabinet assembly and coupled to a second cabinet assembly.
Figure 4A:
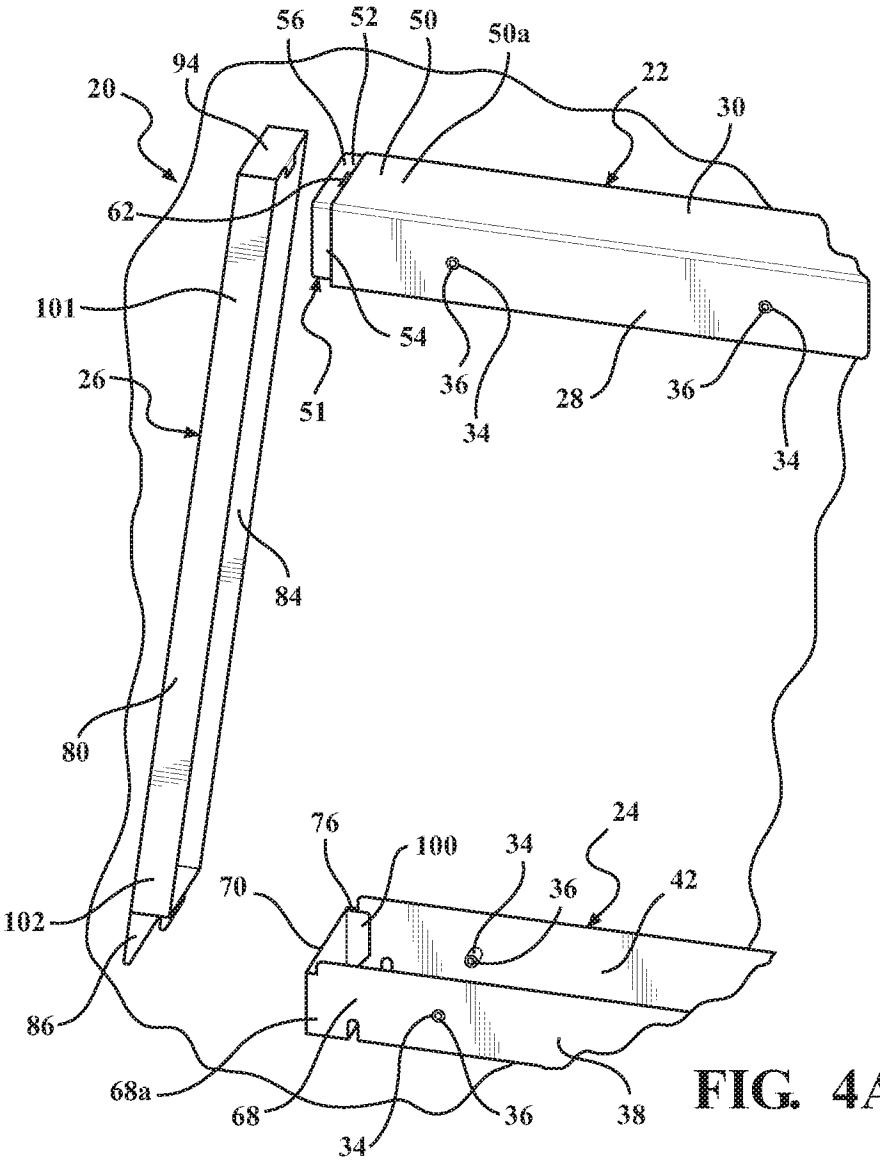
FIG. 4A is a fragmented perspective view of the spacer assembly.
Figure 4:
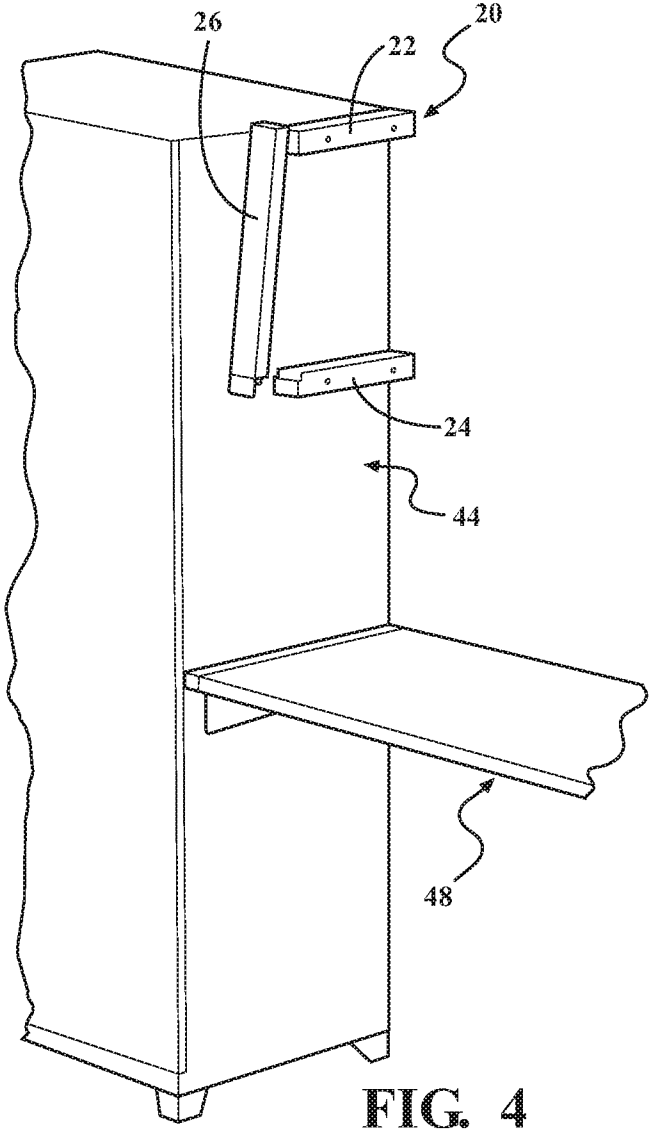
FIG. 4 is a perspective view of the spacer assembly in a first assembly position.
Figure 5A:
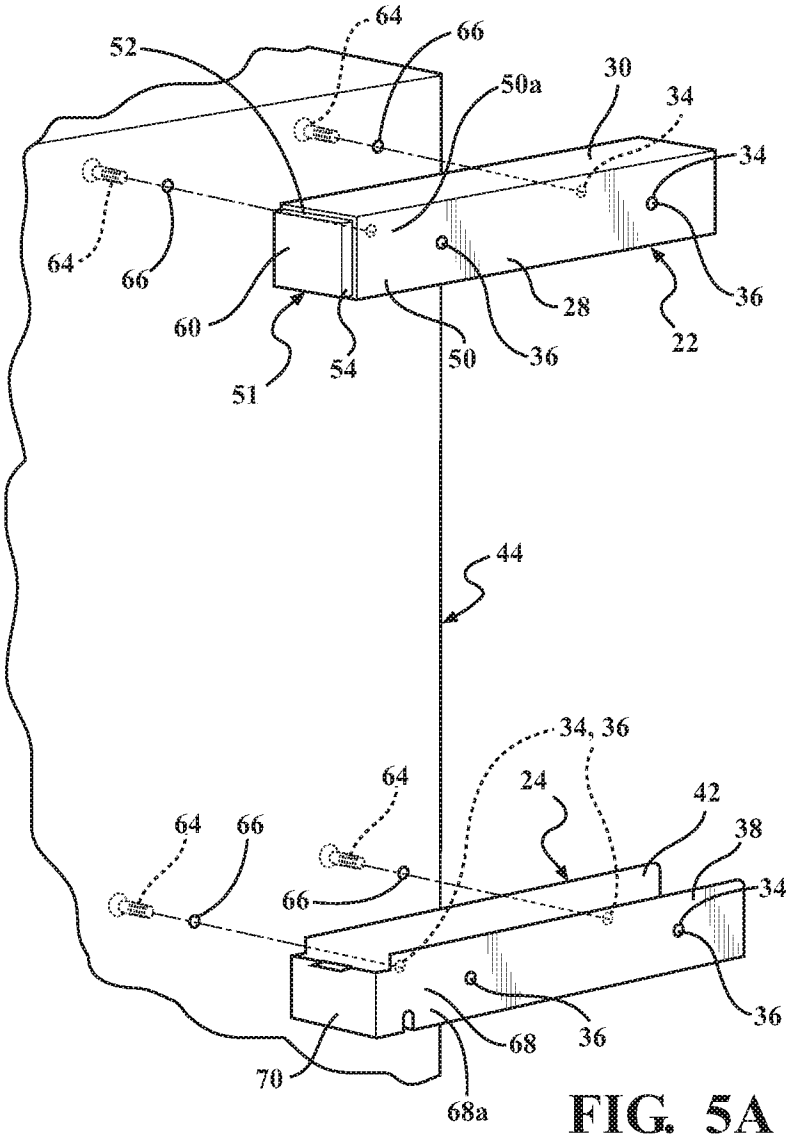
FIG. 5A is a close-up view of a portion of FIG. 5.
Figure 5:
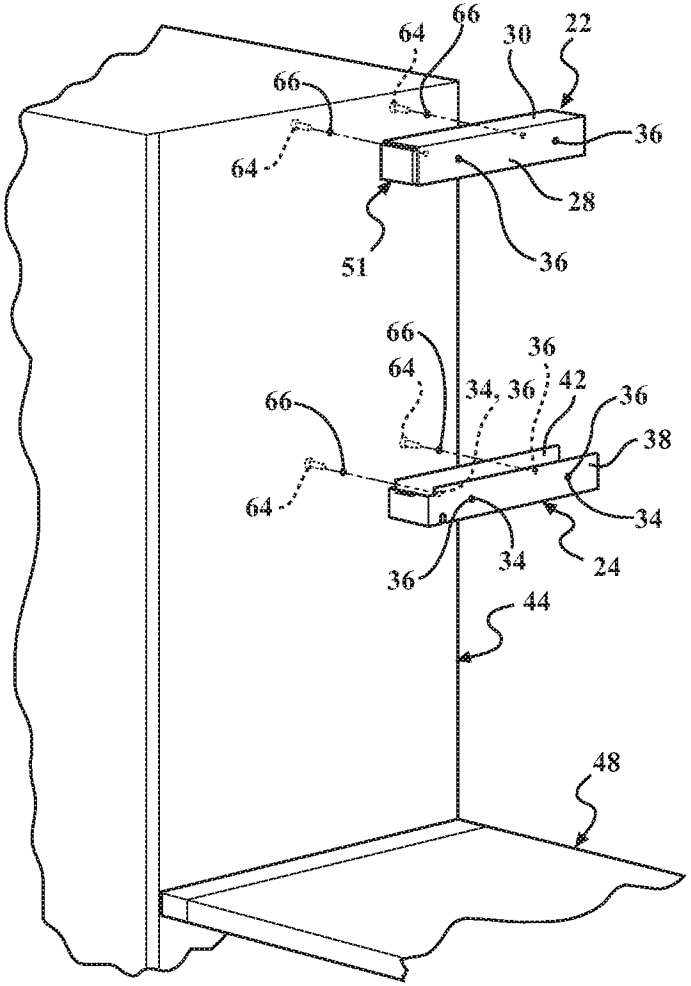
FIG. 5 is a perspective view of a first frame member of the spacer assembly and a second frame member of the spacer assembly adjacent the first cabinet assembly.
Figure 6A:
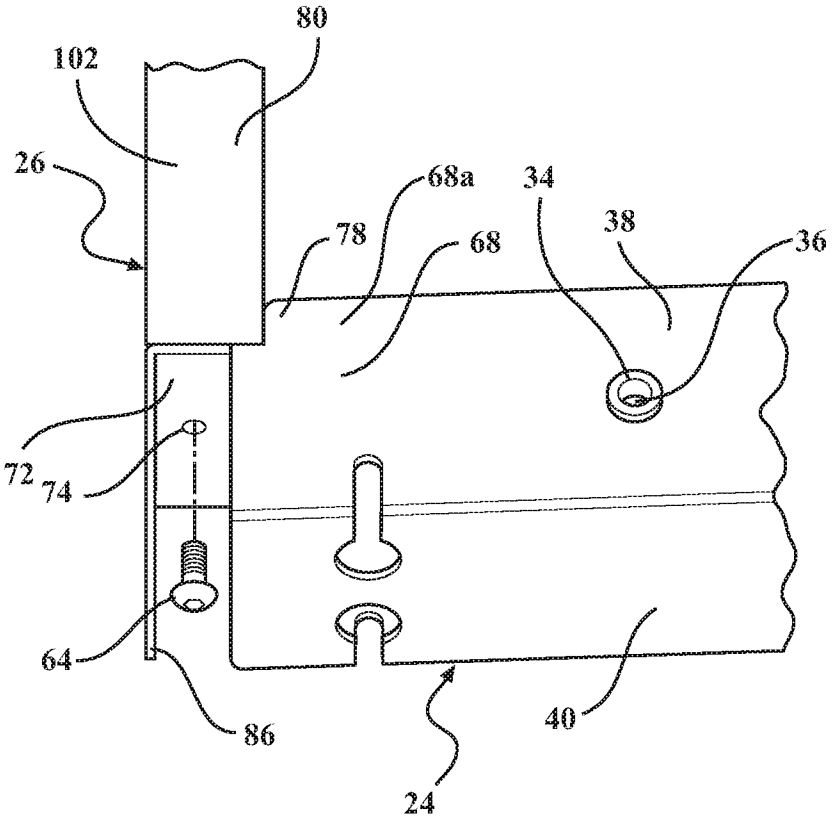
FIG. 6A is a fragmented perspective view of the spacer assembly of FIG. 6 further illustrating male fastening members.
Figure 6:
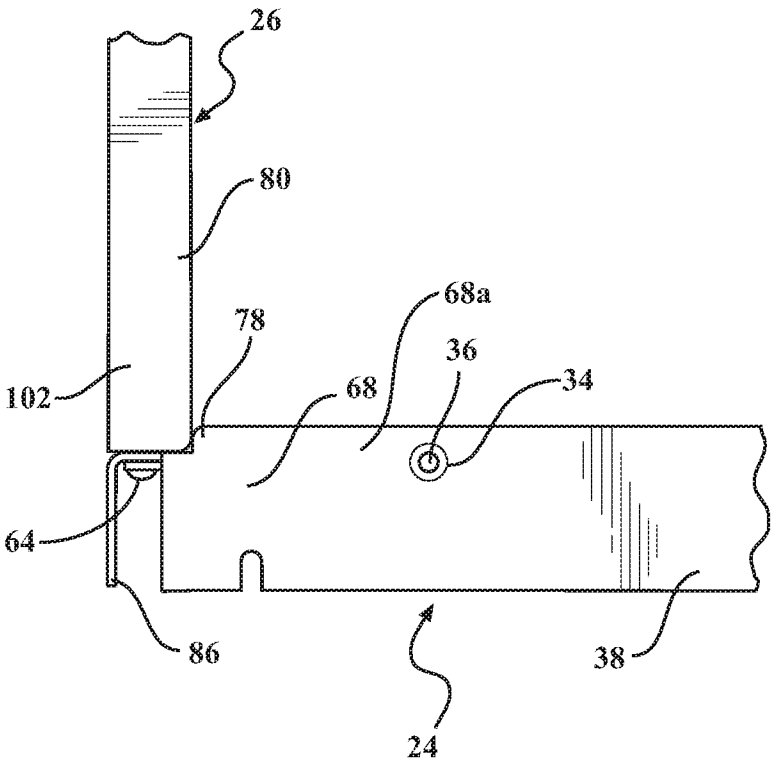
FIG. 6 is a side perspective view of the second frame member and a portion of the decorative cover of the spacer assembly.
Figure 8:
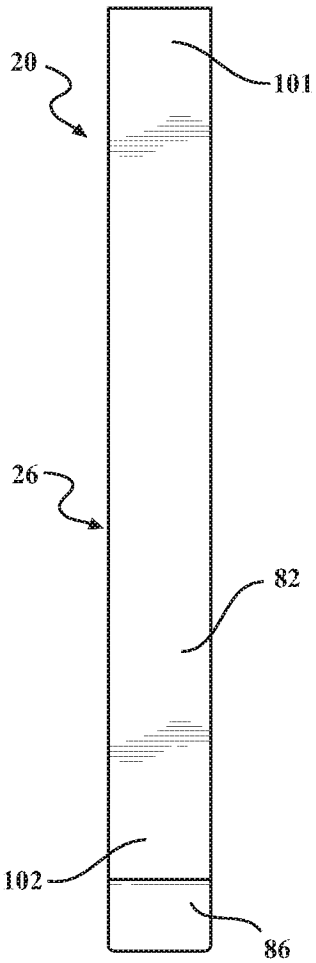
FIG. 8 is a front view of the spacer assembly.
Figure 7:
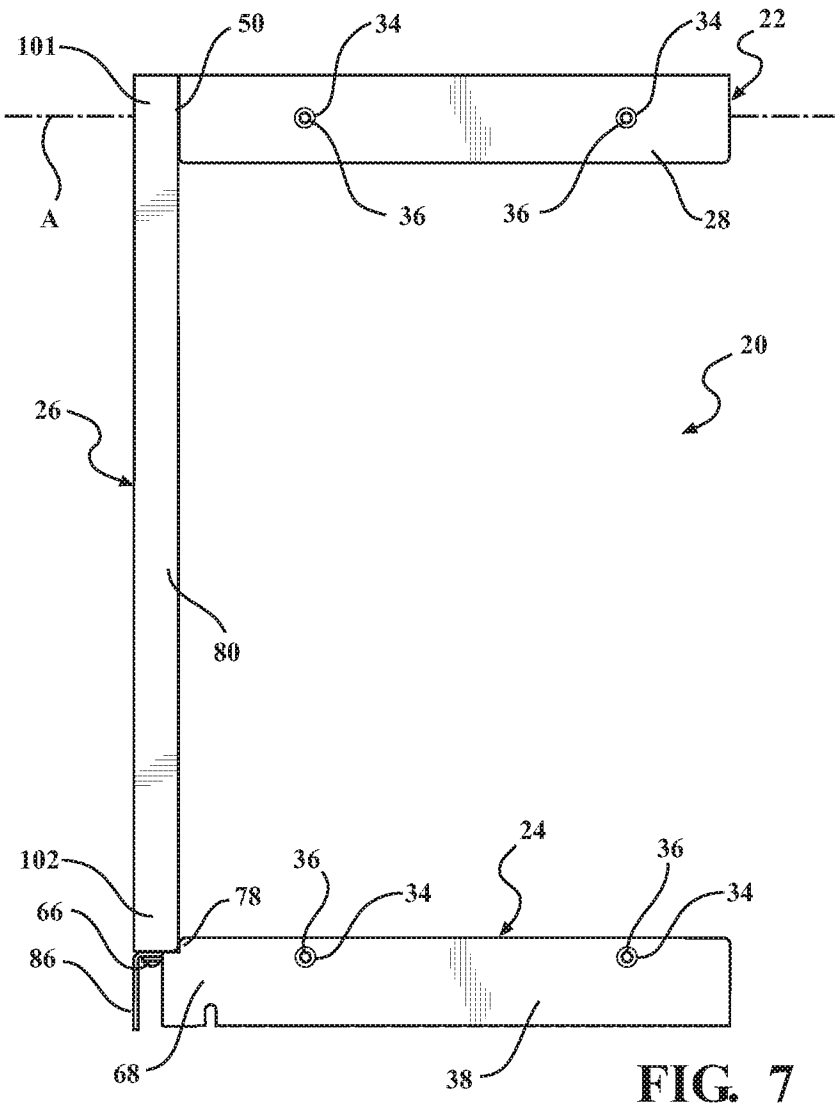
FIG. 7 is a side view of the spacer assembly.

As shown in FIG. 2-5, the spacer assembly 20 further couples to a first cabinet subassembly 44 and couples to a second cabinet subassembly 46 to form a cabinet assembly 19. The first cabinet subassembly 44 may be a locker, such as shown, an open cabinet or book shelf without doors, a dresser, a credenza, a cupboard, a cabinet with any combination of drawers, doors, and shelves, a cabinet as a sub-component of a desk, or any other storage structure having a base and walls. The second cabinet subassembly 46 may be a cabinet, such as shown, a locker, an open cabinet or book shelf without doors, a dresser, a credenza, a cupboard, a cabinet with any combination of drawers, doors, and shelves, a cabinet as a sub-component of a desk, or any other storage structure having a base and walls. The spacer assembly 20 fills a gap between the first cabinet subassembly 44 and the second cabinet subassembly 46 which may be created by a modular bench or tabletop 48, as shown in FIGS. 2, 4, and 5 also coupled to the first cabinet subassembly 44.

As shown in FIG. 3, the spacer assembly 20 is shown coupled to the first cabinet subassembly 44 without being coupled to the second cabinet subassembly 46.

Turning to FIGS. 1, 4-5, 7 and 9-18, the first frame member 22 shown may have a first wall 28 extending along the longitudinal axis A, a second wall 30 extending from the first wall 28 in a direction substantially normal to the first wall 28, and a third wall 32 extending from the second wall 30 in a direction substantially normal to the second wall 30. The first wall 28 and the third wall 32 are thus substantially parallel to one another. The first wall 28 includes at least one protrusion 34 which protrudes from the first wall 28 toward the third wall 32 and which defines a bore 36 therethrough. The third wall 32 includes at least one protrusion 34 which protrudes from the third wall 32 toward the first wall 28 and which defines a bore 36 therethrough.

The term "substantially", as in the phrases "in a direction substantially normal" and "substantially parallel" as described above, is meant to describe wherein the relationship between elements to which it refers has the elements as described, but allows for slight variations or imprecision of the components, or the coupling of the components, as described. By way of example, wherein the term "normal" describes a perpendicular (i.e., a 90 degrees) arrangement between elements, the term substantially allows the elements to be arranged at angles that vary from exactly 90 degrees, such as being offset from perpendicular by a few percent (i.e., 0.1 to about 10 degrees) relative to precisely 90 degrees. Accordingly, the phrase "in a direction substantially normal" refers to an arrangement wherein the length and width of the second wall 30 defines a plane that is transverse and at an angle of 90 degrees, plus or minus 5 degrees, to a corresponding respective plane defined by the first wall 28 and the second wall 32. Similarly, the phrase "substantially parallel", with respect to the first and second frame member 22, 24, includes wherein the plane defined by and extending from the respective first and second frame member 22, 24 along the longitudinal axis are actually angled slightly with respect to the longitudinal axis A and thus would intersect one another and some point along the planes distant from first and second frame members 22, 24).

Similarly to the first frame member 22, the second frame member 24 may have a first wall 38 extending along the longitudinal axis A, a second wall 40 extending from the first wall 38 in a direction substantially normal to the first wall 38, and a third wall 42 extending from the second wall 40 in a direction substantially normal to the second wall 40. The first wall 38 and the third wall 42 are substantially parallel to one another. The first wall 38 includes at least one protrusion 34 which protrudes from the first wall 38 toward the third wall 42 and which defines a bore 36 therethrough. The third wall 42 includes at least one protrusion 34 which protrudes from the third wall 42 toward the first wall 38 and which defines a bore 36 therethrough.

The first frame member 22 may further include a top attachment end 50*a*, defined at one end of each of the first wall 28, second wall 30, and third wall 32, that is proximate to the decorative cover 26, with the first frame member 22 also defining a top non-attachment end 50*b* opposite the top attachment end 50*a*. This top attachment end 50*a* includes a mount 51 which may be fit into an interior region 53 of the top attachment end 50*a* of the first frame member 22, with the interior region 53 defined between the adjacent inner surfaces of the first wall 28, second wall 30, and third wall 32. It is to be appreciated that the mount 51 may be fastened or formed through alternative way such as welding, mechanically affixing, or being formed integrally with the interior region 53 of the first frame member 22 at the top attachment end 50*a*. The mount 51 may further include an indented ledge 52 extending toward the decorative cover 26 and away from the top attachment end 50*a* and top non-attachment end 50*b*. The indented ledge 52 comprises a first lip 54 extending from the first wall 28, along the longitudinal axis A and spaced laterally toward the third wall 32, a second lip 56 extending from the second wall 30, along the longitudinal axis A and spaced laterally toward the second frame member 24, and a third lip 58 extending from the third wall 32, along the longitudinal axis A and spaced laterally toward the first wall 28. Collectively, the first lip 54, the second lip 56, and the third lip 58 form the indented ledge 52. The top attachment end 50*a* further comprises a top plate 60 extending from the first lip 54, the second lip 56, and the third lip 58 in a direction normal to the longitudinal axis A.

Figure 9:
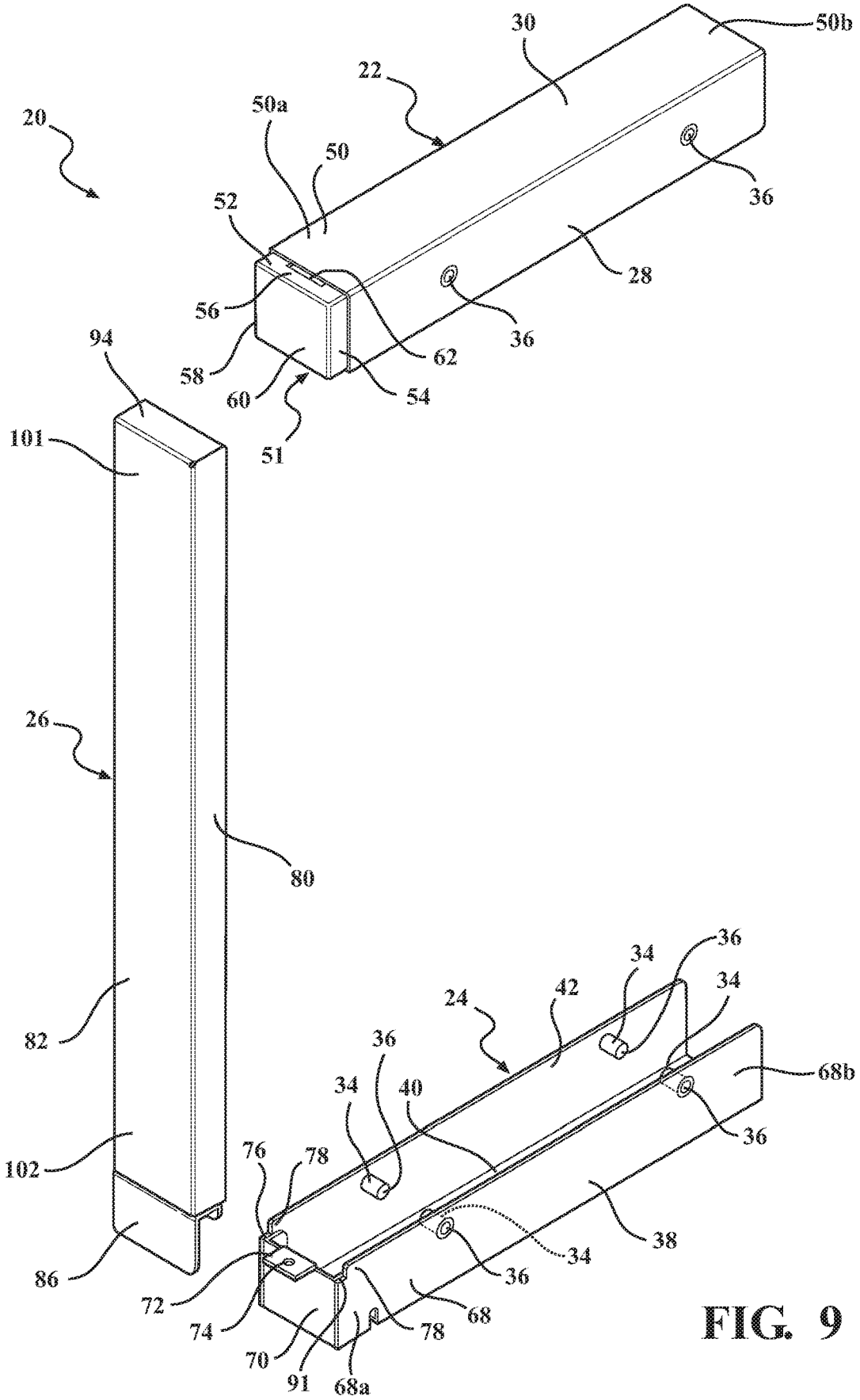
FIG. 9 is a perspective view of the spacer assembly while disassembled.
Figure 10:
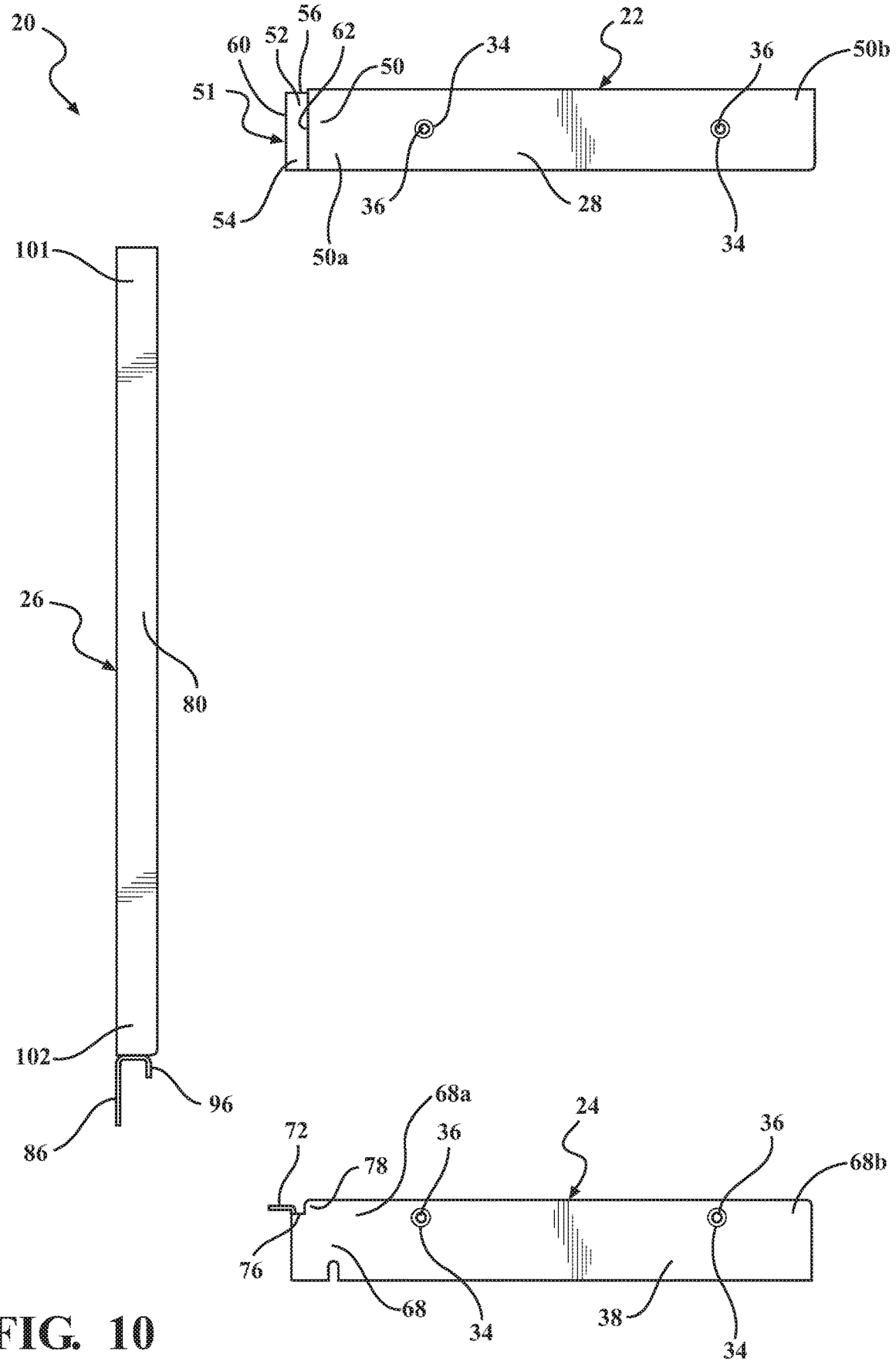
FIG. 10 is an exploded side view of the spacer assembly.
Figure 11:
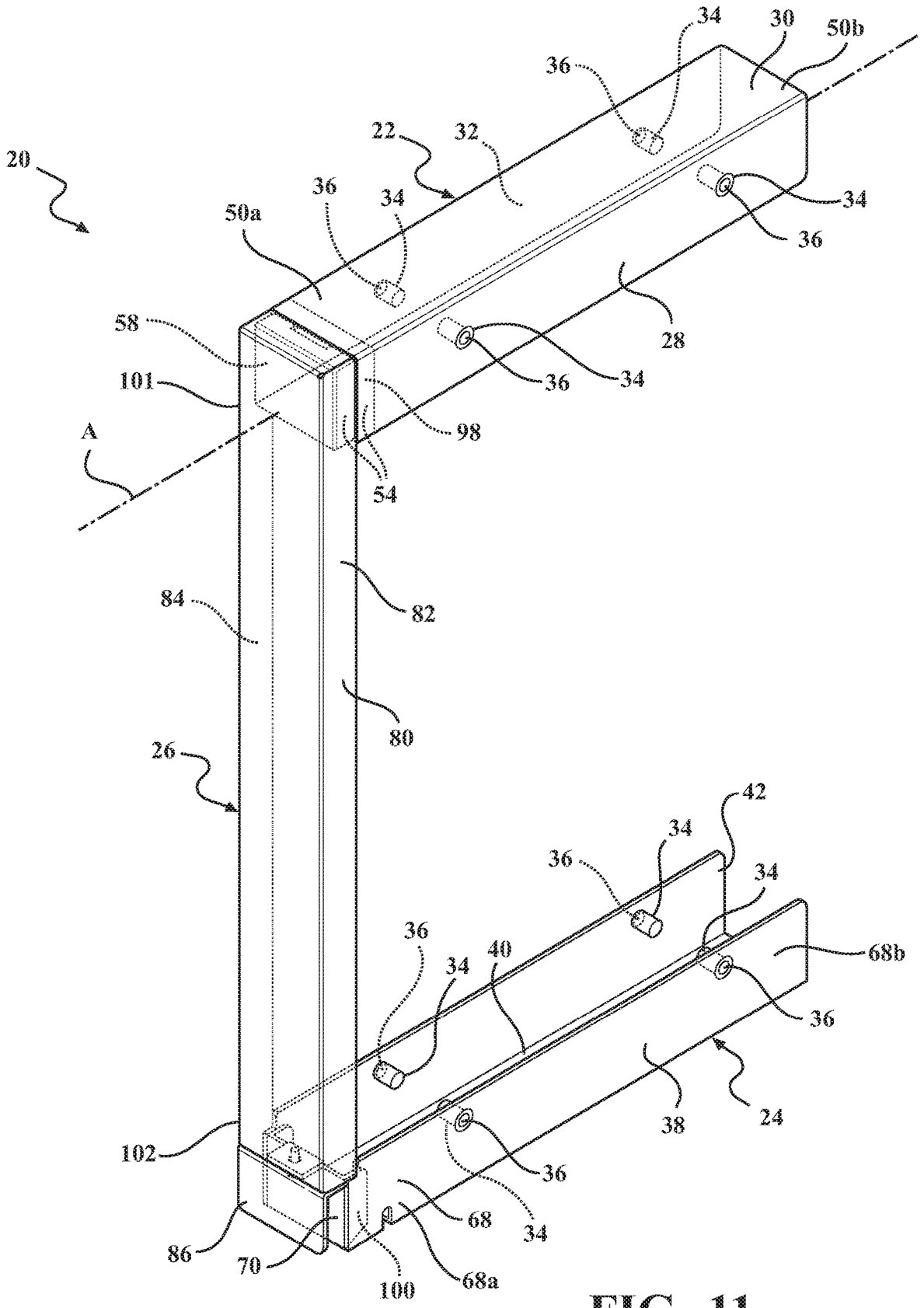
FIG. 11 is a perspective transparent view of the spacer assembly.
Figure 12:
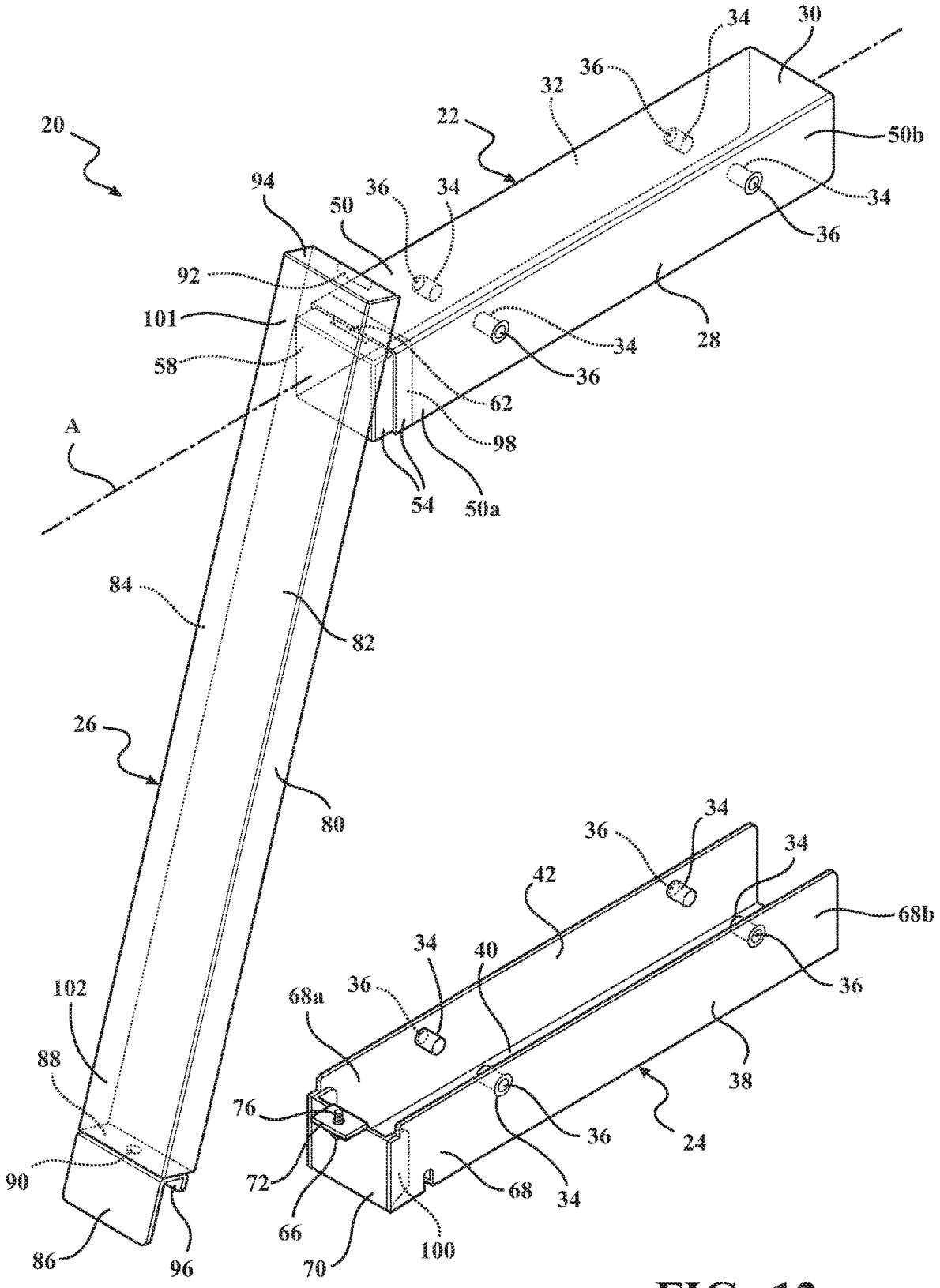
FIG. 12 is a perspective transparent view of the spacer assembly in the first assembly position.
Figure 13:
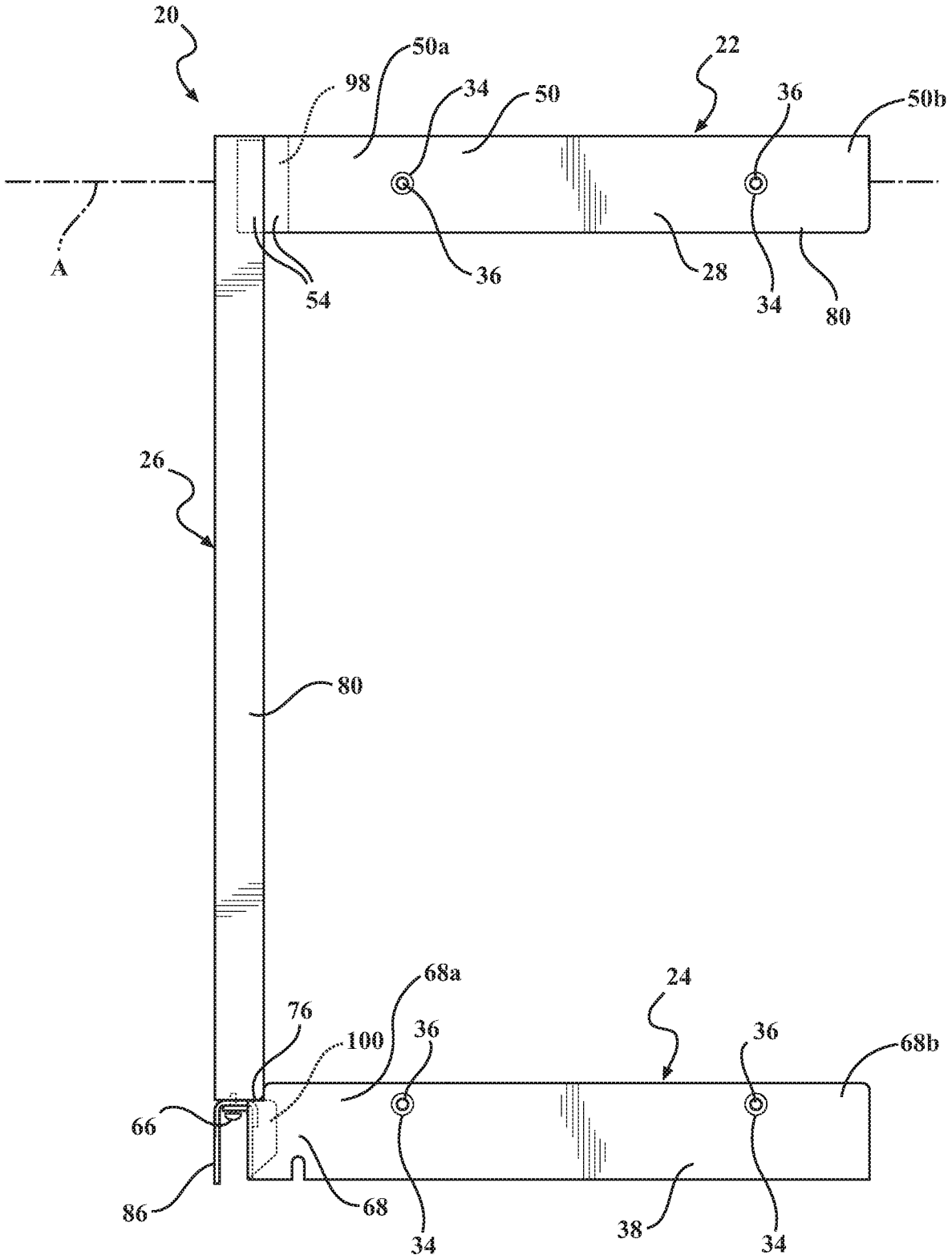
FIG. 13 is a transparent side view of the spacer assembly.
Figure 14:
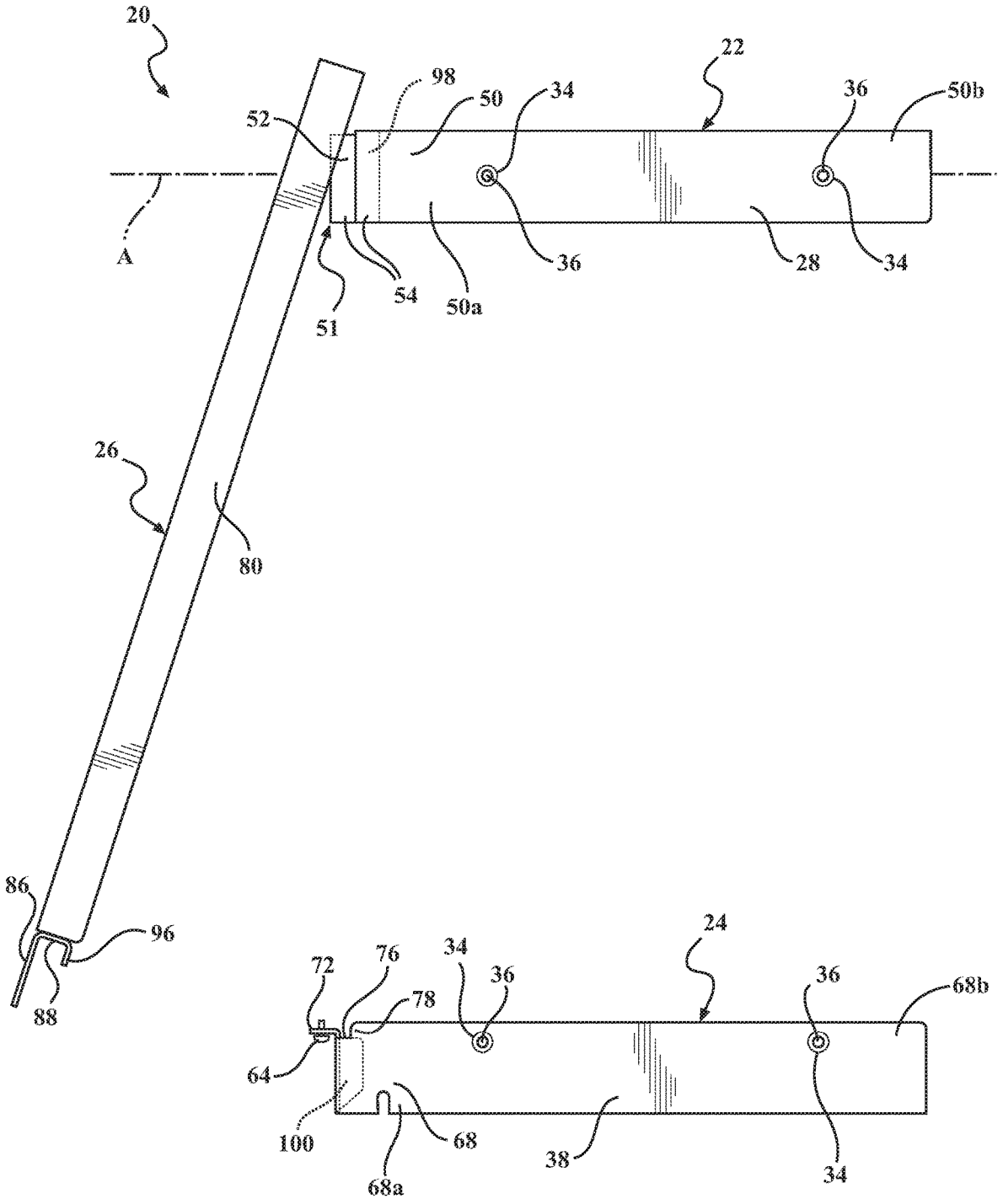
FIG. 14 is a transparent side view of the spacer assembly in the first assembly position.

The second lip 56 of the indented ledge 52 further defines an aperture 62, as shown in FIGS. 9 and 10, extending at least partially through the second lip 56. The second lip 56 may define the aperture 62 to be cylindrical, rectangular, triangular, or any other geometrical configuration.

As shown in FIGS. 5 and 5A, the first frame member 22 and the second frame member 24 may be coupled to the first cabinet subassembly 44. The first cabinet subassembly 44 may have at least one bore 66 which complements (i.e., is axially aligned with) the at least one bore 36 of the protrusion 34 of the first wall 28 of the first frame member 22 or the protrusion 34 of the at least one bore 36 on the first wall 38 of the second frame member 24. A male fastening member 64 may extend through one of the bores 66 of the first cabinet subassembly 44 and through one of the bores 36 of the first wall 28 of the first frame member 22 or one of the bores 36 of the first wall 38 of the second frame member 24 to secure the first frame member 22 or the second frame member 24 to the first cabinet subassembly 44. Preferably, the male fastening member 64 may be a bolt, more preferably a hex bolt. The bore 36 defined by the protrusion 34 of either the first wall 28 of the first frame member 22 or the first wall 38 of the second frame member 24 may further be tapped, threaded, or otherwise configured to receive the male fastening member 64. Washers (not shown) may further be used to aid the male fastening member 64 in fastening the first wall 28 of the first frame member 22 or the first wall 38 of the second frame member 24 to the first cabinet subassembly 44.

In certain embodiments, the total number of bores 66 on the first cabinet subassembly 44 corresponds to the total number of bores 36 on the first frame member 22 and second frame member 24, with each one of the at least one bores 66 axially aligned with a corresponding one of the bores 36 of the first frame member 22 or the second frame member 24 when the spacer assembly 20 is positioned adjacent to the first cabinet subassembly 44 for securing thereto. In this embodiment, a male fastening member 64 is extended through a corresponding one of the axially aligned pairs of bores 66, 36 to secure the spacer assembly 20 to the first cabinet subassembly 44.

While not illustrated in FIG. 5, the first frame member 22 and the second frame member 24 may be coupled to the second cabinet subassembly 46 in substantially the same manner as the first cabinet subassembly 44 described above, with the bores 66 on the second cabinet subassembly 46 being axially aligned with a corresponding one of the bores 36 on the third wall 32 of the first frame member 22 or a corresponding one of the bores 36 on the third wall 42 of the second frame member 24.

Shown in FIGS. 6, 6A, 9-10, 12 and 14-17, the second frame member 24 is shown to include a bottom attachment end 68*a* proximate to the decorative cover 26 which includes a bottom plate 70 extending from the first wall 38, the second wall 40, and the third wall 42 normal to the longitudinal axis A. The second frame member 24 also includes a bottom non-attachment end 68*b* opposite the bottom attachment end 68*a*. The second frame member 24 further includes a flange 72 extending from the bottom plate 70 along the longitudinal axis A in a direction opposite the bottom attachment end 68*a* of the second wall 40 (i.e., wherein the bottom plate 70 is between the flange 72 and the bottom attachment end 68*a* of the second wall 40. The flange 72 defines a bore 74 that may be tapped, threaded, or otherwise configured to receive a male fastening member 64.

The first wall 38 and the third wall 42 of the second frame member 24 may further be shortened or truncated to form a notched region 76 of the bottom attachment end 68*a* such that the flange 72 is flush with a horizontally extending surface 91 of the first wall 38 and the third wall 42. Said differently, the first wall 38 and the third wall 42 may be configured to allow the decorative cover 26 to rest upon the flange 72 and the notched region 76 of the first wall 38 and the third wall 42 evenly and without any gaps. The first wall 38 and the third wall 42 may further be rounded in the transition from the horizontally extending surface 91 of notched region 76 to horizontally extending surface of the first and third wall 38, 42 that is not truncated to avoid contact with the decorative cover 26 while the decorative cover 26 rests upon the flange 72 and the notched regions 76 of the respective first wall 38 and the third wall 42.

As shown in FIGS. 1, 4, 6-7, 9-10 and 14-15, the decorative cover 26 couples to the first frame member 22 at a top end 101 and couples to the second frame member 24 at a bottom end 102. The decorative cover 26 comprises a first wall 80 extending normal to the longitudinal axis A between the top end 101 and the bottom end 102, a second wall 82 extending from the first wall 80 and normal to the longitudinal axis A between the top end 101 and the bottom end 102, and a third wall 84 extending from the first wall 80 normal to the longitudinal axis A between the top end 101 and the bottom end 102. The first wall 80 and the third wall 84 are substantially parallel to one another. The bottom end 102 of the decorative cover 26 further extends from the second wall 82 of the first frame member 22 to the flange 72 and notched region 76 of the first wall 80 and the third wall 84 of the bottom attachment end 68*a* of the second frame member 24. The decorative cover 26 may further include a paneled ledge 86 extending from the bottom end 102 of the second wall 82 of the decorative cover 26 (i.e., downward from the bottom end 102 as shown in the FIG. 1). The paneled ledge 86 may further allow access to the flange 72 to secure the male fastening member 64 to the flange 72.

As shown in FIGS. 12, 14, 17, and 18, the decorative cover 26 panel may further include a bottom cover plate 88 coupled to the bottom end 102 of each of the respective first wall 80, the second wall 82, and the third wall 84, with the bottom cover plate 88 extending along the longitudinal axis A towards the second frame member 24. The bottom cover plate 88 may extend only partially toward the curved section 78 of the second frame member 24 or completely to the curved section 78 of the second frame member 24. The bottom cover plate 88 may further define a bore 90 which may be tapped, threaded, or otherwise configured to receive the male fastening member 64. The bore 90 of the bottom cover plate 88 axially aligns with the bore 74 of the flange 72 such that the male fastening member 64 may extend through both the bore 90 defined by the bottom cover plate 88 and the bore 74 defined by the flange 72 to secure the decorative cover 26 to the second frame member 24. The decorative cover 26 may further include a bottom securing ledge 96 extending from the bottom cover plate 88, normal to the longitudinal axis A, and toward the second wall 40 of the second frame member 24 relative to the paneled ledge 86 such that the decorative cover 26 is further secured against movement along the longitudinal axis A relative to the second frame member 24 when the decorative cover 26 is coupled to the second frame member 24. In this manner, the bottom securing ledge 96 of the decorative cover 26 is spaced from the paneled ledge 86 and is positioned between the bottom plate 70 of the second attachment section and the paneled ledge 86 of the decorative cover 26.

As shown in FIGS. 1, 4, 9, and 12, the decorative panel may further comprises a top cover plate 94 proximate to the first frame member 22 and extending from the first wall 80, the second wall 82, and the third wall 84 along the longitudinal axis A. The top cover plate 94 may extend only partially toward the second wall 30 of the first frame member 22 or completely to the second wall 30 of the first frame member 22. The decorative cover 26 may further comprise a top securing ledge 92 extending from the top cover plate 94 and which is configured to extend at least partially through the aperture 62 of the second lip 56 of the indented ledge 52. The top securing ledge 92 may further be configured to complement the aperture 62, and may be cylindrical, rectangular, triangular, or any other geometrical configuration.

As shown in FIGS. 11-14, the mount 51 may further define a first reinforcement section 98 wherein the first wall 28, the second wall 30, and the third wall 32 of the first frame member 22 have increased thickness which comes about as a result of the mount 51 overlapping with the first wall 28, the second wall 30, and the third wall 32. The first reinforcement section 98 may further increase stability, strength, and durability of the spacer assembly 20.

The second frame member 24 may further include a second reinforcement section 100 wherein the first wall 38 and the third wall 42 have increased thickness which comes about as a result of the bottom plate 70 of the second frame member 24 overlapping the first wall 38 and the third wall 42 of the second frame member 24. The second reinforcement section 100 may further increase stability, strength, and durability of the spacer assembly 20.

Figure 15:
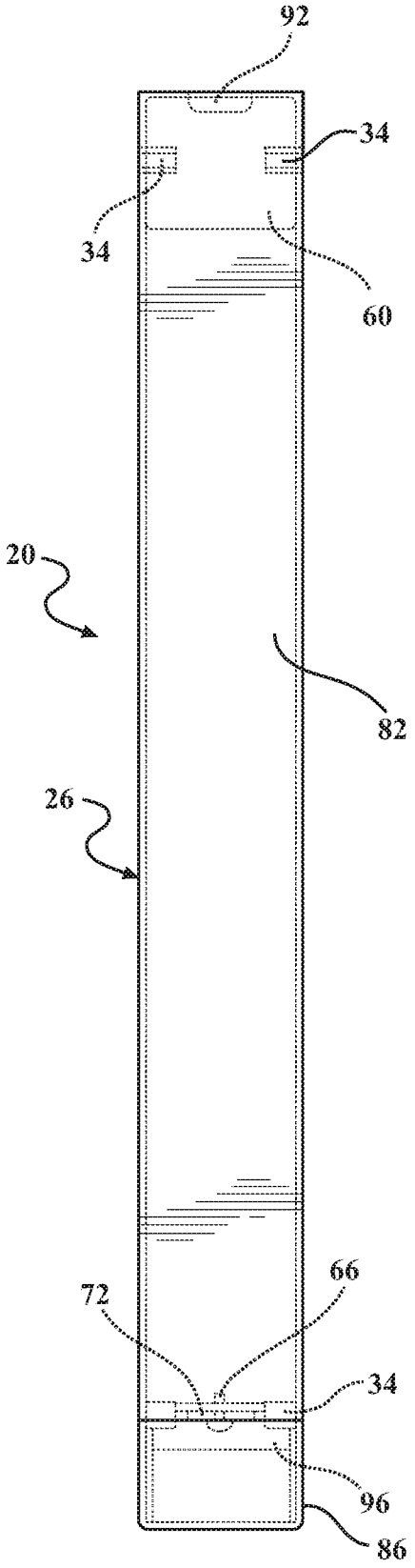
FIG. 15 is a transparent front view of the spacer assembly.
Figure 16:
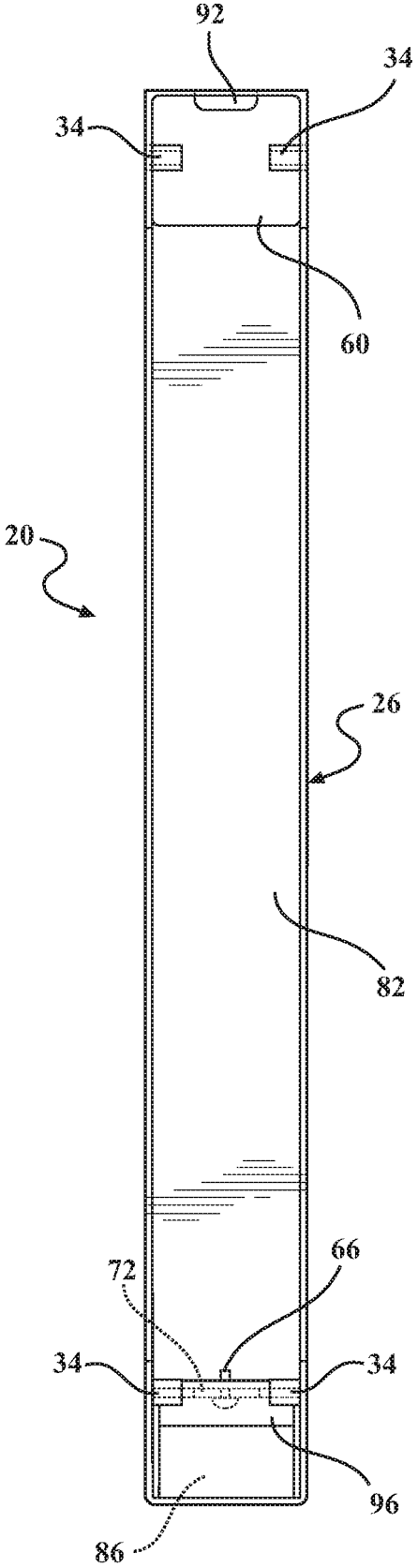
FIG. 16 is a transparent rear view of the spacer assembly.

As shown in FIGS. 15 and 16, the paneled ledge 86 of the spacer assembly 20 may extend to completely block the second frame member 24 from view while viewing along the longitudinal axis A. The protrusions 34 of the first frame member 22 may further be positioned approximately equidistance from a top of the first wall 28 of the first frame member 22 and a bottom of the first wall 28 of the first frame member 22, or equidistance from a top of the third wall 32 of the first frame member 22 and a bottom of the third wall 32 of the first frame member 22. The protrusions 34 of the second frame member 24 may further be positioned closer to a top of the first wall 38 of the second frame member 24 and a bottom of the first wall 38 of the second frame member 24, or closer to a top of the third wall 42 of the second frame member 24 and a bottom of the third wall 42 of the second frame member 24.

Figure 17:
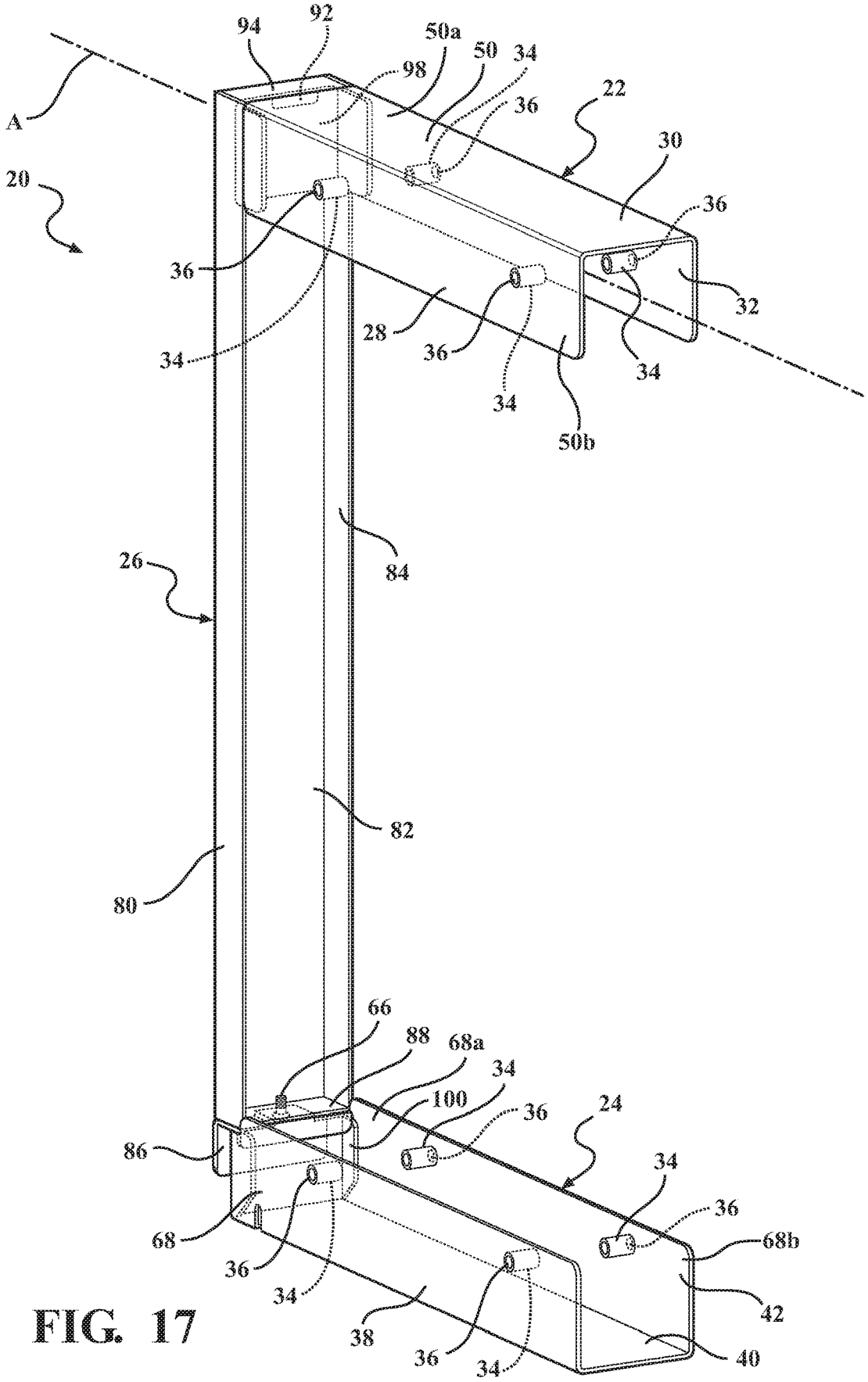
FIG. 17 is a perspective transparent rear view of the spacer assembly.
Figure 18:
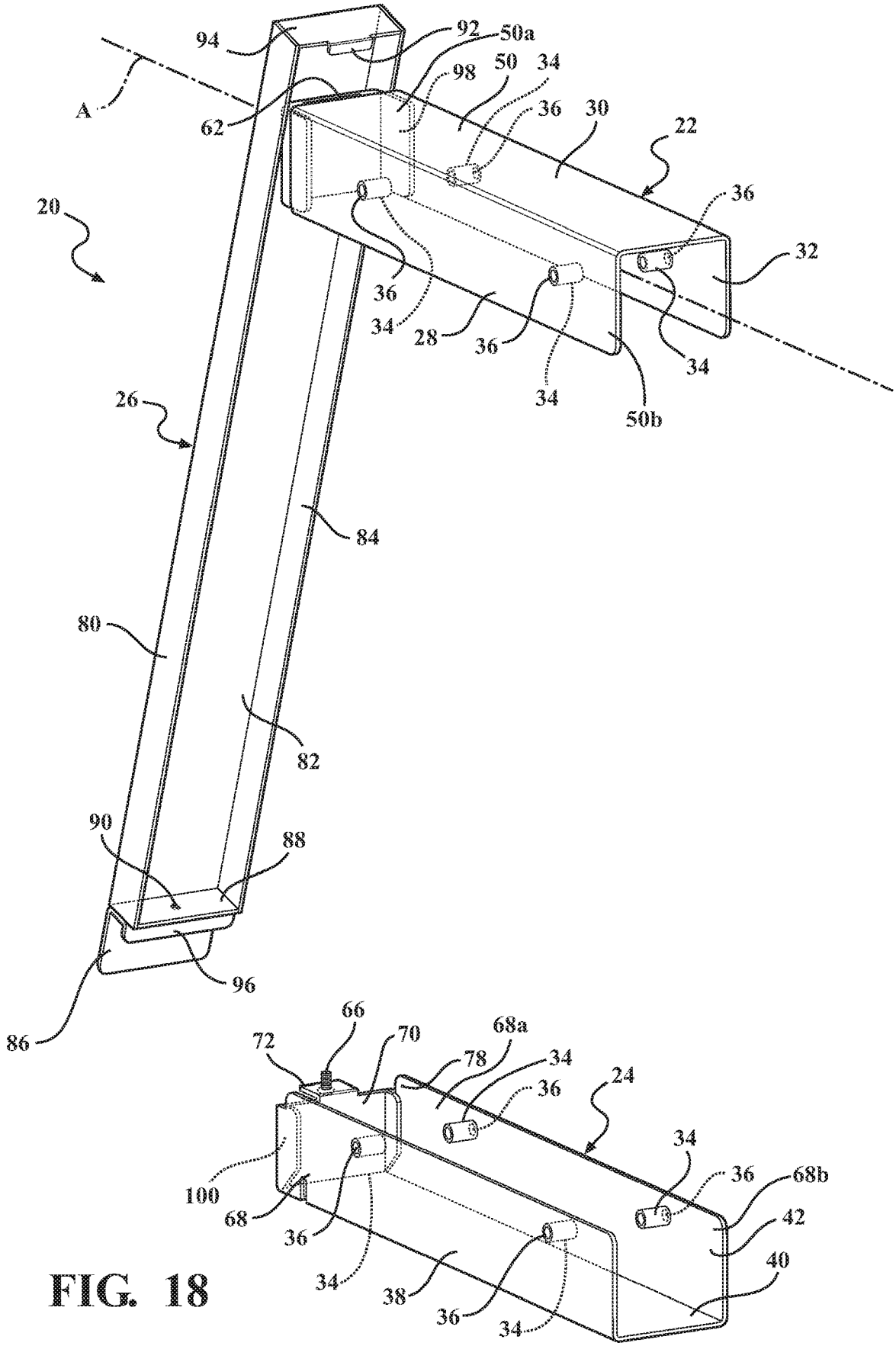
FIG. 18 is a perspective transparent rear view of the spacer assembly in the first assembly position.

As shown in FIGS. 17 and 18, the first frame member 22 may abut the decorative cover 26 along the first lip 54, the second lip 56, the third lip 58, and/or top plate 60 of the first frame member 22. Correspondingly, the decorative cover 26 may abut the first frame member 22 along the first wall 80, the second wall 82, the third wall 84, the top cover plate 94, and/or the top securing ledge 92 of the decorative cover 26. The second frame member 24 may abut the decorative cover 26 along the bottom plate 70, the flange 72, the first wall 38, and/or the third wall 42 of the second frame member 24. Correspondingly, the decorative cover 26 may abut the second frame member 24 along the first wall 80, the third wall 84, the bottom cover plate 88, and/or the second flange 72.

A method for assembly the spacer assembly 20 includes a step of coupling the first frame member 22 to the first cabinet subassembly 44 through use of one or more of the male fastening members 66. The second frame member 24 is then coupled to the first cabinet subassembly 44 through the use of one or more of the male fastening members 66. The first frame member 22 and the second frame member 24 are aligned in a substantially parallel position.

Following the step of coupling the first frame member 22 and the second frame member 24 to the first cabinet subassembly 44, the decorative cover 26 may be coupled to the first frame member 22 and to the second frame member 24. The top cover plate 94 and the bottom securing ledge 96 of the decorative cover 26 may be aligned with the aperture 62 of the second lip 56 of the first frame member 22 such that the decorative cover 26 is coupled to first frame member 22. The decorative cover 26 may further be coupled to the second frame member 24 by aligning the bottom cover plate 88 and the top securing ledge 92 with the flange 72 of the second frame member 24 and inserting one or more of the male fastening members 66 through both the bore 74 defined by the flange 72 and through the bore 90 defined by the bottom cover plate 88. In this way, the decorative cover 26 is coupled to the second frame member 24.

The method may further include coupling the second cabinet subassembly 46 the spacer assembly 20 through use of one or more of the male fastening members 66. The male fastening member 64 may be inserted through one of the bores 64 of the second cabinet subassembly 46 and through one of the bores 36 of the protrusion 34 of the first frame member 22 to secure the second cabinet subassembly 46 to the spacer assembly 20. The male fastening member 64 may further be inserted through one of the bores 64 of the second cabinet subassembly 46 and through one of the bores 36 of the protrusion 34 of the second frame member 24 to secure the second cabinet subassembly 46 to the spacer assembly 20. The secured first cabinet subassembly 44, spacer assembly 20, and second cabinet subassembly 46 therefore form the cabinet assembly 19.

The invention has been described in an illustrative manner, and it is to be understood that the terminology which has been used is intended to be in the nature of words of description rather than limitation. Many modifications and variations of the present invention are possible in light of the above teachings, and the invention may be practiced otherwise than as specifically described.

The invention claimed is:

1. A spacer assembly for use with a first cabinet subassembly and a second cabinet subassembly to form a cabinet assembly, said spacer assembly comprising:

a first frame member having a top attachment end and a top non-attachment end opposite said top attachment end, said first frame member comprising:

a plurality of walls extending along a longitudinal axis between said top attachment end and said top non-attachment end, and a mount coupled to said top attachment end, said mount having a ledge extending outwardly away from said top attachment end along said longitudinal axis such that said top attachment end is between said ledge and said top non-attachment end;

a second frame member having a bottom attachment end and a bottom non-attachment end opposite said bottom attachment end, said second frame member comprising:

a plurality of walls extending along a longitudinal axis between said bottom attachment end and said bottom non-attachment end, and a flange extending outwardly away from said plurality of walls along said longitudinal axis; and a decorative cover having:

a top portion positioned on and supported by said ledge, a top securing ledge secured to said ledge of said mount, and a bottom portion engaging said flange to secure said decorative cover to said first and second frame members, wherein said plurality of walls of said second frame member comprises a first wall, a second wall and a third wall, with said first wall substantially parallel to said third wall, said second wall coupled between said first and third wall and extending normal to said first and third wall, and wherein said first wall and said third wall of said second frame member are shortened to each define a notched region such that a bottom cover plate of said decorative cover is seated on a horizontally extending surface of said notched region of said first wall and said third wall.

2. The spacer assembly of claim 1, wherein said plurality of walls of said first frame member comprises a first wall, a second wall and a third wall, with said first wall substantially parallel to said third wall, said second wall coupled between said first and third wall and extending normal to said first and third wall.

3. The spacer assembly of claim 2, wherein said decorative cover has a top cover plate, and wherein said ledge of said first frame member comprises:

a first lip extending from said first wall and outwardly away from said top attachment end along said longitudinal axis, a second lip extending from said second wall and outwardly away from said top attachment end along said longitudinal axis, and a third lip extending from said third wall and outwardly away from said top attachment end along said longitudinal axis;

wherein said top cover plate is positioned on said second lip.

4. The spacer assembly of claim 3, wherein said second lip further comprises an aperture extending at least partially through said second lip.

5. The spacer assembly of claim 4, wherein said top securing ledge extends from said top cover plate and within said aperture.

6. The spacer assembly of claim 1 wherein said first frame member further comprises a top plate coupled to said ledge and spaced from said top attachment end, said top plate extending normal to said longitudinal axis.

7. The spacer assembly of claim 1, wherein said second frame member further comprises a bottom plate coupled to said bottom attachment end and extending in a direction normal to said longitudinal axis.

8. The spacer assembly of claim 1, wherein said decorative cover further comprises a paneled ledge extending in a direction normal to said longitudinal axis and in a direction towards a second wall of said second frame member.

9. The spacer assembly of claim 8, wherein said decorative cover further comprises a bottom securing ledge extending from a bottom cover plate in a direction normal to said longitudinal axis, said bottom securing ledge spaced from said paneled ledge and positioned between said bottom cover plate and said paneled ledge.

10. The spacer assembly of claim 1, wherein said first wall and said third wall of said second frame member are rounded along a curved section between said notched region and said non-attachment end.

11. The spacer assembly of claim 1, wherein said ledge includes an aperture, and wherein said top securing ledge is secured to said mount within said aperture.

12. A cabinet assembly comprising:

a first cabinet subassembly;

a second cabinet subassembly; and a spacer assembly secured to said first cabinet subassembly and said second cabinet subassembly, said spacer assembly comprising:

a first frame member having a top attachment end and a top non-attachment end opposite said top attachment end, said first frame member comprising:

a plurality of walls extending along a longitudinal axis between said top attachment end and said top non-attachment end, and a mount coupled to said top attachment end, said mount including a ledge extending outwardly away from said top attachment end along said longitudinal axis such that said top attachment end is between said ledge and said top non-attachment end, a second frame member having a bottom attachment end and a bottom non-attachment end opposite said bottom attachment end, said second frame member comprising:

a plurality of walls extending along a longitudinal axis between said bottom attachment end and said bottom non-attachment end, and a flange extending outwardly away from said plurality of walls along said longitudinal axis, and a decorative cover having a top portion secured to said mount and supported by said ledge, and having a bottom portion engaging said flange to secure said decorative cover to said first and second frame members, wherein said first frame member and said second frame member each include at least one protrusion defining a bore that is axially aligned with a corresponding one bore of said first cabinet subassembly, wherein a male fastening member is inserted through one of said at least one bores of said protrusion of said first frame member and through an axially aligned one of said bores of said first cabinet subassembly, and wherein a male fastening member is inserted through one of said at least one bores of said protrusion of said second frame member and through an axially aligned one of said bores of said first cabinet subassembly.

13. The cabinet assembly of claim 12, wherein each of said first frame member and said second frame member includes at least one protrusion defining a bore that is axially aligned with a corresponding one bore of said second cabinet subassembly, wherein a male fastening member is inserted through one of said at least one bores of said protrusion of said first frame member and through an axially aligned one of said at least two bores of said second cabinet subassembly, and wherein a male fastening member is inserted through one of said at least one bores of said protrusion of said second frame member and through an axially aligned one of said at least two bores of said second cabinet subassembly.

14. A cabinet assembly comprising:

a first cabinet subassembly;

a second cabinet subassembly; and a spacer assembly secured to said first cabinet subassembly and said second cabinet subassembly, said spacer assembly comprising:

a first frame member having a top attachment end and a top non-attachment end opposite said top attachment end, said first frame member comprising:

a plurality of walls extending along a longitudinal axis between said top attachment end and said top non-attachment end, and a mount coupled to said top attachment end, said mount including a ledge extending outwardly away from said top attachment end along said longitudinal axis such that said top attachment end is between said ledge and said top non-attachment end, a second frame member having a bottom attachment end and a bottom non-attachment end opposite said bottom attachment end, said second frame member comprising:

a plurality of walls extending along a longitudinal axis between said bottom attachment end and said bottom non-attachment end, and a flange extending outwardly away from said plurality of walls along said longitudinal axis, and a decorative cover having a top portion secured to said mount and supported by said ledge, and having a bottom portion engaging said flange to secure said decorative cover to said first and second frames, wherein said decorative cover includes a bottom cover plate, said bottom cover plate and said flange each respectively defining a bore, and wherein a male fastening member is inserted through said bore of said bottom cover plate and said bore of said flange to secure said decorative cover to said second frame member.

15. A method for forming a cabinet assembly, said method comprising:

providing a first cabinet subassembly and a second cabinet subassembly each including at least two bores;

forming a first frame member having a plurality of walls each extending along a longitudinal axis between a top attachment end and a top non-attachment end opposite the top attachment end, wherein the first frame member includes at least one protrusion defining a bore, the first frame member including a mount having a ledge coupled to the top attachment end of the first frame member such that the top attachment end is between the ledge and the top non-attachment end;

forming a second frame member having a plurality of walls each extending along a longitudinal axis between a bottom attachment end and a bottom non-attachment end, wherein the second frame member includes at least one protrusion defining a bore, the second frame member also including a flange extending outwardly away from the bottom plate along the longitudinal axis such that the bottom plate is between the flange and the bottom attachment end;

securing the first frame member to the first cabinet subassembly by inserting a male fastening member through one of the at least two bores of the first cabinet subassembly and a corresponding one of the at least one bore of the first frame member;

securing the second frame member to the first cabinet subassembly by inserting a male fastening member through another one of the at least two bores of the first cabinet subassembly and a corresponding one of the at least one bore of the second frame member;

forming a decorative cover having a top portion and a bottom portion;

coupling the decorative cover to the first frame member and the second frame member by seating the bottom portion on the second frame member and seating the top portion on the ledge;

securing the decorative cover to the second frame member;

securing the first frame member to the second cabinet subassembly by inserting a male fastening member through one of the at least two bores of the second cabinet subassembly and a corresponding one of the at least one bore of the first frame member; and securing the second frame member to the second cabinet subassembly by inserting a male fastening member through another one of the at least two bores of the second cabinet subassembly and a corresponding one of the at least one bore of the second frame member.

16. The method of claim 15, wherein the plurality of walls of the first frame member comprises a first wall, a second wall and a third wall, with the first wall substantially parallel to the third wall, the second wall coupled between the first and third wall and extending normal to the first and third wall, wherein the ledge of the first frame member comprises a first lip extending from the first wall and outwardly away from the top attachment end along the longitudinal axis, a second lip extending from the second wall and outwardly away from the top attachment end along the longitudinal axis, the second lip including an aperture, and a third lip extending from the third wall and outwardly away from the top attachment end along the longitudinal axis, wherein the top portion of the decorative plate includes a top securing ledge extending from the top cover plate in a direction normal to said longitudinal axis, and wherein said step of coupling the decorative cover to the first frame member and the second frame member further includes extending the top securing ledge within the aperture.

17. The method of claim 15, wherein the bottom portion of the decorative cover includes a bottom cover plate, the bottom cover plate and the flange each respectively defining a bore, and wherein said step of securing the decorative cover to the second frame member comprises inserting a male fastening member through the bore of the bottom cover plate and through the bore of the flange.

* * * * *